US011152147B2

(12) United States Patent
Cho et al.

(10) Patent No.: US 11,152,147 B2
(45) Date of Patent: Oct. 19, 2021

(54) COIL COMPONENT

(71) Applicant: SAMSUNG ELECTRO-MECHANICS CO., LTD., Suwon-si (KR)

(72) Inventors: Tai Yon Cho, Suwon-si (KR); Chang Hak Choi, Suwon-si (KR); Byeong Cheol Moon, Suwon-si (KR); Sang Jong Lee, Suwon-si (KR); Hee Soo Yoon, Suwon-si (KR); Tae Jun Choi, Suwon-si (KR); Seung Hee Oh, Suwon-si (KR); Su Bong Jang, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 532 days.

(21) Appl. No.: 16/178,452

(22) Filed: Nov. 1, 2018

(65) Prior Publication Data

US 2019/0259529 A1 Aug. 22, 2019

(30) Foreign Application Priority Data

Feb. 22, 2018 (KR) ..... 10-2018-0021345
May 28, 2018 (KR) ..... 10-2018-0060196

(51) Int. Cl.
*H01F 27/36* (2006.01)
*H01F 27/28* (2006.01)
(Continued)

(52) U.S. Cl.
CPC ..... *H01F 27/2804* (2013.01); *H01F 17/0013* (2013.01); *H01F 27/292* (2013.01);
(Continued)

(58) Field of Classification Search
CPC .. H01F 27/36; H01F 17/0013; H01F 27/2804; H01F 41/041; H01F 27/292;
(Continued)

(56) References Cited

U.S. PATENT DOCUMENTS 10,186,367 B2 1/2019 Lee et al.
2004/0159960 A1* 8/2004 Fujiwara ..... H03H 9/1078 257/783
(Continued)

FOREIGN PATENT DOCUMENTS

CN 105869833 A 8/2016
CN 105957692 A 9/2016
(Continued)

OTHER PUBLICATIONS

Office Action issued in corresponding Korean Application No. 10-2018-0060196, dated May 31, 2019.
(Continued)

*Primary Examiner* — Tuyen T Nguyen
(74) *Attorney, Agent, or Firm* — Morgan, Lewis & Bockius LLP

(57) ABSTRACT

A coil component includes: a body having a first surface and a second surface opposing each other in a thickness direction of the body and a wall surface connecting the first and second surfaces; a coil part including coil patterns and including at least one turn centered on the thickness direction; external electrodes disposed on the first surface of the body and electrically connected to the coil part; a shielding layer including a cap portion disposed on the second surface of the body and side wall portions disposed on the wall surface of the body and each having a first end connected to the cap portion; an insulating layer disposed between the body and the shielding layer; and a gap portion bounded by a second end of the shielding layer opposing the first end and the first surface of the body to expose portions of the wall surface.

14 Claims, 10 Drawing Sheets

(51) Int. Cl.
*H01F 41/04* (2006.01)
*H01F 27/29* (2006.01)
*H01F 17/00* (2006.01)

(52) U.S. Cl.
CPC ..... *H01F 27/36* (2013.01); *H01F 41/041* (2013.01); *H01F 2017/008* (2013.01); *H01F 2027/2809* (2013.01)

(58) Field of Classification Search
CPC ..... H01F 2017/008; H01F 2027/2809; H01F 27/2885; H01F 27/323; H01F 27/346
See application file for complete search history.

(56) References Cited

U.S. PATENT DOCUMENTS

| | | | | |
|---|---|---|---|---|
| 2011/0249416 | A1* | 10/2011 | Takai | H01L 23/552 361/760 |
| 2014/0176280 | A1 | 6/2014 | Lee et al. | |
| 2015/0116950 | A1 | 4/2015 | Yoo et al. | |
| 2016/0234979 | A1 | 8/2016 | Lee et al. | |
| 2016/0240296 | A1 | 8/2016 | Kim et al. | |
| 2016/0268038 | A1 | 9/2016 | Choi | |
| 2016/0351314 | A1 | 12/2016 | Jeong et al. | |
| 2018/0166211 | A1* | 6/2018 | Takatsuji | H02M 3/156 |
| 2020/0020477 | A1* | 1/2020 | Kang | H01F 27/292 |

FOREIGN PATENT DOCUMENTS

| | | | |
|---|---|---|---|
| CN | 106205955 | A | 12/2016 |
| JP | 2005-310863 | A | 11/2005 |
| JP | 4073682 | B2 | 4/2008 |
| KR | 10-2014-0083579 | A | 7/2014 |
| KR | 10-2016-0098780 | A | 8/2016 |
| KR | 10-2016-0099882 | A | 8/2016 |
| KR | 10-2016-0138634 | A | 12/2016 |

OTHER PUBLICATIONS

Office Action issued in corresponding Chinese Patent Application No. 201910078507.1 dated Dec. 23, 2020, with English translation.

* cited by examiner

Ⅱ-Ⅱ'

COIL COMPONENT

CROSS-REFERENCE TO RELATED APPLICATION(S)

This application claims the benefit of priority to Korean Patent Application Nos. 10-2018-0021345 filed on Feb. 22, 2018 and 10-2018-0060196 filed on May 28, 2018 in the Korean Intellectual Property Office, the disclosure of which is incorporated herein by reference in its entirety.

TECHNICAL FIELD

The present disclosure relates to a coil component.

BACKGROUND

An inductor, a coil component, is a representative passive electronic component used in an electronic device, together with a resistor and a capacitor.

In accordance with high performance and miniaturization of the electronic device, electronic components used in the electronic devices have increased in number and decreased in size.

Due to the above-mentioned reason, requirements for removing a noise generation source such as electromagnetic interference (EMI) of the electronic component have gradually increased.

Currently, in a general EMI shielding technology, after mounting an electronic component on a board, the electronic component and the board are simultaneously enclosed by a shield can.

SUMMARY

An aspect of the present disclosure may provide a coil component capable of decreasing a leakage magnetic flux.

An aspect of the present disclosure may also provide a coil component capable of substantially maintaining characteristics of the component while decreasing a leakage magnetic flux.

According to an aspect of the present disclosure, a coil component may include: a body having a first surface and a second surface opposing each other in a thickness direction of the body and a wall surface connecting the first surface and the second surface to each other; external electrodes disposed on the first surface of the body and electrically connected to the coil part; a shielding layer including a cap portion disposed on the second surface of the body and side wall portions disposed on the wall surface of the body, each of the side wall portions having a first end connected to the cap portion and a second end opposing the one end; and a gap portion bounded by the second end of the shielding layer and the first surface of the body to expose portions of the wall surface of the body.

According to another aspect of the present disclosure, a coil component may include: a body having a first surface and a second surface opposing each other in a thickness direction of the body and a plurality of wall surfaces connecting the first surface and the second surface to each other; a coil part including first and second coil patterns embedded in the body and stacked in the thickness direction; first and second external electrodes disposed on the first surface of the body to be spaced apart from each other, and connected to the first and second coil patterns, respectively; a shielding layer including a cap portion disposed on the second surface of the body and side wall portions disposed on the plurality of wall surfaces of the body, respectively, and each having a first end connected the cap portion and a second end opposing the first end; an external insulating layer disposed between the body and the shielding layer and between the first and second external electrodes and the shielding layer; and a gap portion bounded by the second end of the shielding layer and the first surface of the body and allowing the second end of each of the side wall portions to be spaced apart from the first surface of the body in the thickness direction.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
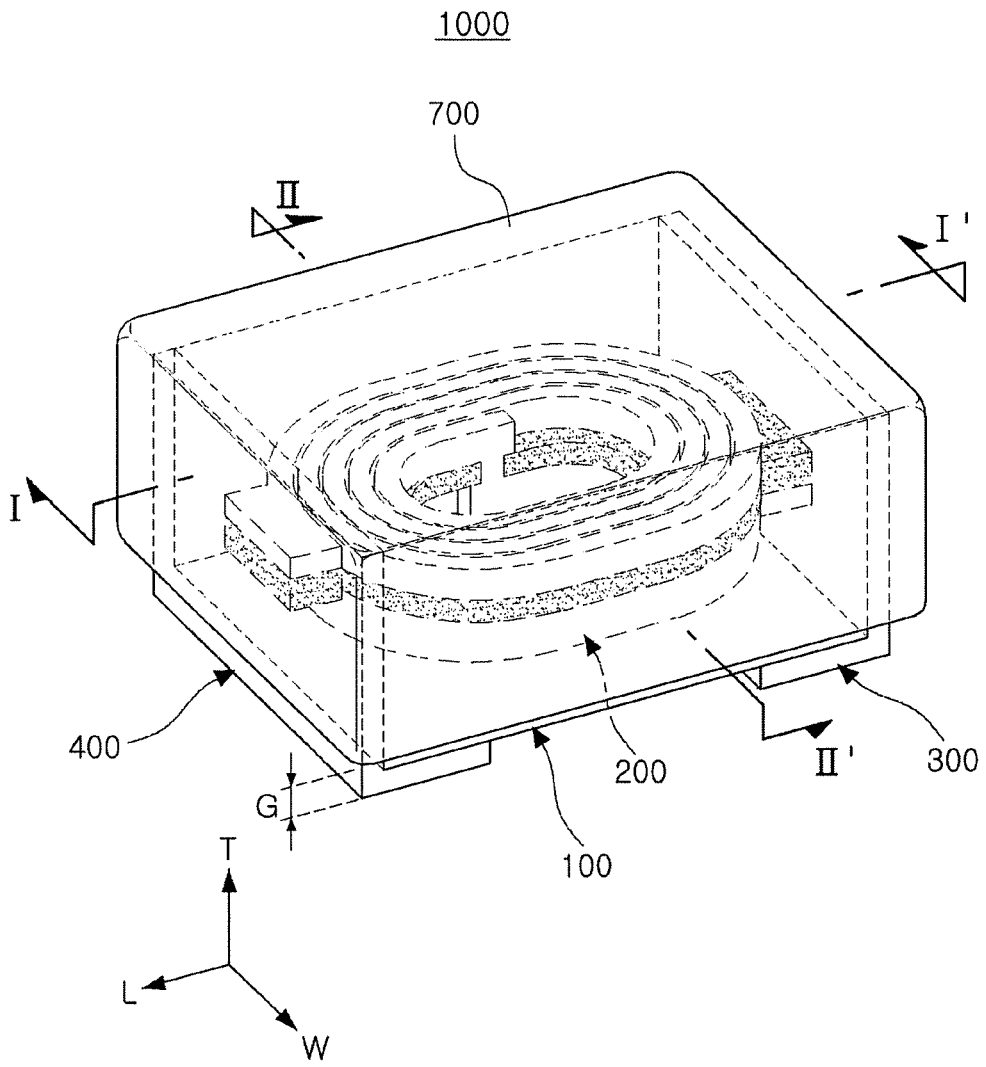
FIG. 1 is a perspective view schematically showing a coil component according to a first exemplary embodiment in the present disclosure.

Hereinafter, exemplary embodiments of the present disclosure will now be described in detail with reference to the accompanying drawings.

In the accompanying drawings, an L direction refers to a first direction or a length direction, a W direction refers to a second direction or a width direction, and a T direction refers to a third direction or a thickness direction.

Hereinafter, a coil component according to an exemplary embodiment in the present disclosure will be described in detail with reference to the accompanying drawings. In describing an exemplary embodiment in the present disclosure with reference to the accompanying drawings, components that are the same as or correspond to each other will be denoted by the same reference numerals, and an overlapped description thereof will be omitted.

Various kinds of electronic components are used in an electronic device, and various kinds of coil components may be appropriately used for the purpose of removing noise, or the like, between the electronic components.

That is, the coil component may be used as a power inductor, a high-frequency (HF) inductor, a general bead, a GHz bead, a common mode filter, and the like, in the electronic device.

First Exemplary Embodiment

Figure 2A:
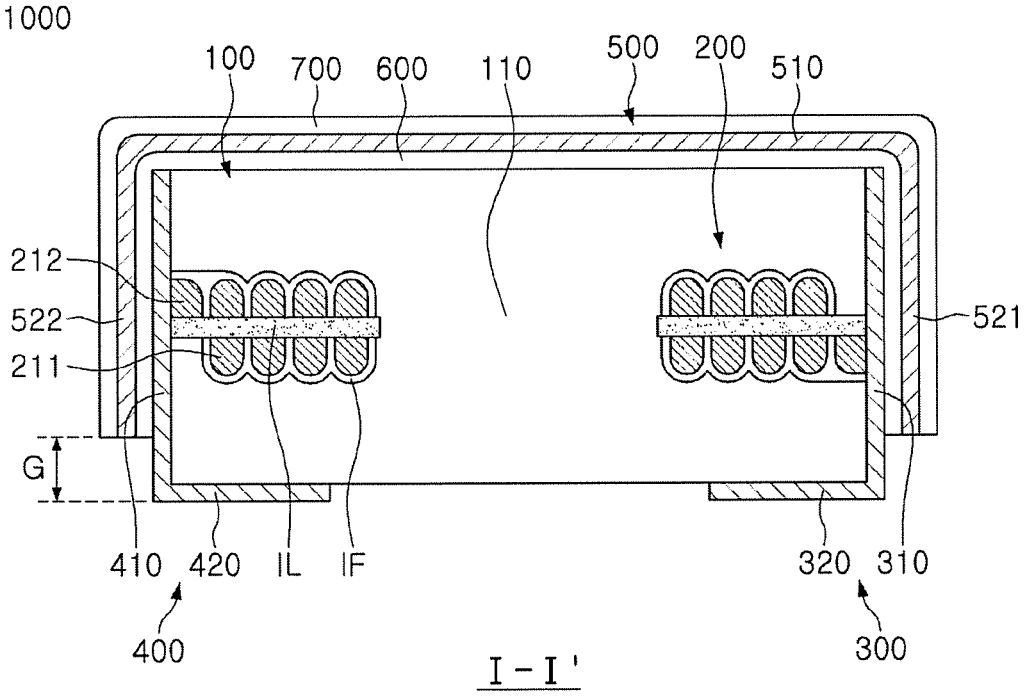
FIG. 2A is a cross-sectional view taken along line I-I' of FIG. 1.
Figure 2B:
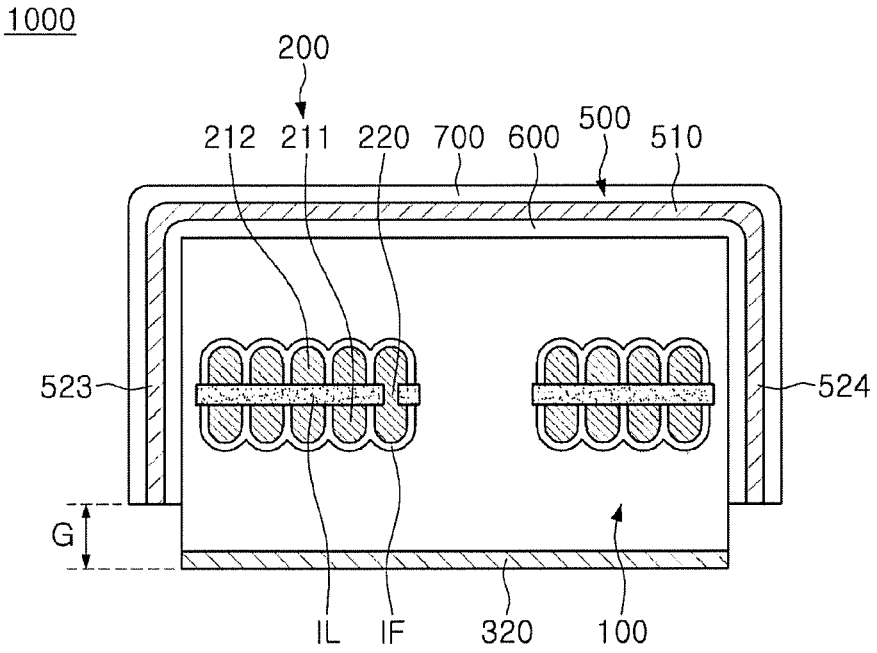
FIG. 2B is a cross-sectional view taken along line II-II' of FIG. 1.
Figure 3:
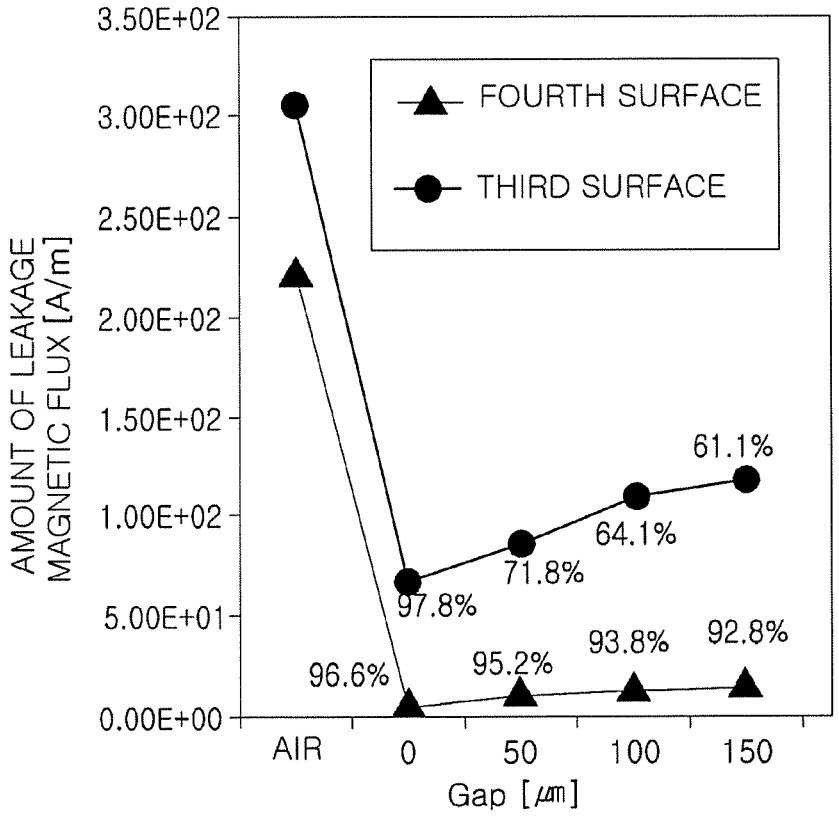
FIG. 3 is a graph illustrating a leakage magnetic flux depending on a length of a gap portion.

FIG. 1 is a perspective view schematically showing a coil component according to a first exemplary embodiment in the present disclosure. FIG. 2A is a cross-sectional view taken along line I-I' of FIG. 1. FIG. 2B is a cross-sectional view taken along line II-II' of FIG. 1. FIG. 3 is a graph illustrating a leakage magnetic flux depending on a length of a gap portion.

Referring to FIGS. 1 through 2B, a coil component 1000 according to the first exemplary embodiment in the present disclosure may include a body 100, a coil part 200, external electrodes 300 and 400, a shielding layer 500, an insulating layer 600, and a gap portion G, and further include a cover layer 700, an internal insulating layer IL, and an insulating film IF.

The body 100 may form an exterior of the coil component 1000 according to the present exemplary embodiment, and the coil part 200 may be embedded therein.

The body 100 may be formed in an entirely hexahedral shape.

Hereinafter, as an example, the first exemplary embodiment in the present disclosure will be described on the assumption that the body 100 has a hexahedral shape. However, a coil component including a body formed in a shape other than the hexahedral shape is not excluded in the scope of the present exemplary embodiment by the description.

The body 100 may have first and second surfaces opposing each other in the length (L) direction, third and fourth surfaces opposing each other in the width (W) direction, and fifth and sixth surfaces opposing each other in the thickness (T) direction. The first to fourth surfaces of the body 100 may correspond to wall surfaces of the body 100 connecting the fifth and sixth surfaces of the body 100 to each other. The wall surfaces of the body 100 may include the first and second surfaces corresponding to both end surfaces and the third and fourth surfaces corresponding to both side surfaces opposing each other.

The body 100 may be formed so that the coil component 1000 in which external electrodes 300 and 400, an insulating layer 600, a shielding layer 500, and a cover layer 700 to be described below are formed has a length of 2.0 mm, a width of 1.2 mm, and a thickness of 0.65 mm, but the body 100 is not limited thereto. Meanwhile, the above-mentioned numerical values of the length, the width, and the thickness of the coil component are values without considering tolerances and an actual length, an actual width, and an actual thickness of the coil component may be different from the numerical values described above by the tolerances.

The body 100 may contain a magnetic material and a resin. More specifically, the body may be formed by stacking one or more magnetic composite sheets in which the magnetic material is dispersed in the resin. However, the body 100 may also have a different structure other than a structure in which the magnetic material is dispersed in the resin. For example, the body 100 may also be formed of a magnetic material such as ferrite.

The magnetic material may be ferrite or a metal magnetic powder.

As an example, the ferrite may be at least one of spinel type ferrite such as Mg—Zn based ferrite, Mn—Zn based ferrite, Mn—Mg based ferrite, Cu—Zn based ferrite, Mg—Mn—Sr based ferrite, and Ni—Zn based ferrite; hexagonal ferrite such as Ba—Zn based ferrite, Ba—Mg based ferrite, Ba—Ni based ferrite, Ba—Co based ferrite, and Ba—Ni—Co based ferrite; garnet type ferrite such as Y based ferrite; and Li based ferrite.

The metal magnetic powder may contain one or more selected from the group consisting of iron (Fe), silicon (Si), chromium (Cr), cobalt (Co), molybdenum (Mo), aluminum (Al), niobium (Nb), copper (Cu), and nickel (Ni). For example, the metal magnetic powder may be at least one of pure iron powder, Fe—Si based alloy powder, Fe—Si—Al based alloy powder, Fe—Ni based alloy powder, Fe—Ni—Mo based alloy powder, Fe—Ni—Mo—Cu based alloy powder, Fe—Co based alloy powder, Fe—Ni—Co based alloy powder, Fe—Cr based alloy powder, Fe—Cr—Si based alloy powder, Fe—Si—Cu—Nb based alloy powder, Fe—Ni—Cr based alloy powder, and Fe—Cr—Al based alloy powder.

The metal magnetic powder may be amorphous or crystalline. For example, the metal magnetic powder may be Fe—Si—B—Cr based amorphous alloy powder, but is not necessarily limited thereto.

The ferrite and the metal magnetic powder may each have an average diameter of about 0.1 μm to 30 μm, but are not limited thereto.

The body 100 may contain two or more kinds of magnetic materials dispersed in the resin. Here, the phrase "different kinds of magnetic materials" means that the magnetic materials dispersed in the resin are distinguished from each other in any one of an average diameter, a composition, crystallinity, and a shape thereof.

The resin may include one or a mixture of epoxy, polyimide, a liquid crystal polymer (LCP), and the like, but is not limited thereto.

The body 100 may include a core 110 penetrating through a coil part 200 to be described below. The core 110 may be formed by filling the magnetic composite sheet in a through hole of the coil part 200, but is not limited thereto.

The coil part 200 may be embedded in the body 100 and exhibit characteristics of the coil component. For example, when the coil component 1000 is used as a power inductor, the coil part 200 may serve to stabilize a power source of an electronic device by storing an electric field as a magnetic field to maintain an output voltage.

The coil part 200 may include a first coil pattern 211, a second coil pattern 212, and a via 220.

The first and second coil patterns 211 and 212 and an internal insulating layer IL to be described below may be formed to be sequentially stacked in the thickness (T) direction of the body 100.

The first and second coil patterns 211 and 212 may each be formed in a flat spiral shape. As an example, the first coil pattern 211 may form at least one turn on one surface of the internal insulating layer IL centered on the thickness (T) direction of the body 100.

The via 220 may penetrate through the internal insulating layer IL so as to electrically connect the first and second coil patterns 211 and 212 to each other, thereby coming in contact with each of the first and second coil patterns 211 and 212. As a result, the coil part 200 applied in the present exemplary embodiment may be formed as a single coil generating a magnetic field in the thickness (T) direction of the body 100.

At least one of the first and second coil patterns 211 and 212 and the via 220 may include at least one conductive layer.

As an example, when the second coil pattern 212 and the via 220 are formed by plating, the second coil pattern 212 and the via 220 may each include a seed layer of an electroless plating layer and an electroplating layer. Here, the electroplating layer may have a monolayer structure or a multilayer structure. The electroplating layer having the multilayer structure may also be formed in a conformal film structure in which one electroplating layer is covered with another electroplating layer. Alternatively, the electroplating layer having the multilayer structure may also be formed so that only on one surface of one electroplating layer, another plating layer is stacked. The seed layer of the second coil pattern 212 and the seed layer of the via 220 may be formed integrally with each other so that a boundary therebetween is not formed, but the seed layer of the second coil pattern 212 and the seed layer of the via 220 are not limited thereto. The electroplating layer of the second coil pattern 212 and the electroplating layer of the via 220 may be formed integrally with each other so that a boundary therebetween is not formed, but the electroplating layer of the second coil pattern 212 and the electroplating layer of the via 220 are not limited thereto.

As another example, when the coil part 200 is formed by separately forming the first and second coil patterns 211 and 212 and then collectively stacking the first and second coil patterns 211 and 212 on the internal insulating layer IL, the via 220 may include a high-melting point metal layer and a low-melting point metal layer having a melting point lower than that of the high-melting point metal layer. Here, the low-melting point metal layer may be formed of solder containing lead (Pb) and/or tin (Sn). The low-melting point metal layer may be at least partially melted by a pressure and a temperature at the time of collective stacking, such that an inter-metallic compound (IMC) layer may be formed in a boundary between the low-melting point metal layer and the second coil pattern 212.

As an example, the first and second coil patterns 211 and 212 may be formed to protrude on lower and upper surfaces of the internal insulating layer (IL), respectively. As another example, the first coil pattern 211 may be embedded in the lower surface of the internal insulating layer IL so that a lower surface thereof is exposed to the lower surface of the internal insulating layer IL, and the second coil pattern 212 may be formed to protrude on the upper surface of the internal insulating layer IL. In this case, a concave portion may be formed in the lower surface of the first coil pattern 211, such that the lower surface of the internal insulating layer IL and the lower surface of the first coil pattern 211 may not be positioned on the same plane. As another example, the first coil pattern 211 may be embedded in the lower surface of the internal insulating layer IL so that a lower surface thereof is exposed to the lower surface of the internal insulating layer IL, and the second coil pattern 212 may be embedded in the upper surface of the internal insulating layer IL so that an upper surface thereof is exposed to the upper surface of the internal insulating layer IL.

End portions of the first and second coil patterns 211 and 212 may be exposed to the first and second surfaces of the body 100, respectively. The end portion of the first coil pattern 211 exposed to the first surface of the body 100 may come in contact with a first external electrode 300 to be described below, such that the first coil pattern 211 may be electrically connected to the first external electrode 300. The end portion of the second coil pattern 212 exposed to the second surface of the body 100 may come in contact with a second external electrode 400 to be described below, such that the second coil pattern 212 may be electrically connected to the second external electrode 400.

The first and second coil patterns 211 and 212 and the via 220 may each be formed of a conductive material such as copper (Cu), aluminum (Al), silver (Ag), tin (Sn), gold (Au), nickel (Ni), lead (Pb), titanium (Ti), or alloys thereof, but are not limited thereto.

The internal insulating layer IL may be formed of an insulating material including at least one of thermosetting insulating resins such as an epoxy resin, thermoplastic insulating resins such as polyimide, and photosensitive insulating resins, or an insulating material in which a reinforcing material such as glass fiber or an inorganic filler is impregnated in this insulating resin. As an example, the internal insulating layer IL may be formed of an insulating material such as prepreg, an Ajinomoto build-up film (ABF), FR-4, a bismaleimide triazine resin, a photoimageable dielectric (PID), or the like, but is not limited thereto.

As the inorganic filler, at least one selected from the group consisting of silica ($SiO_2$), alumina ($Al_2O_3$), silicon carbide (SiC), barium sulfate ($BaSO_4$), talc, mud, mica powder, aluminum hydroxide ($AlOH_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$) may be used.

When the internal insulating layer IL is formed of an insulating material containing a reinforcing material, the internal insulating layer IL may provide more excellent rigidity. When the internal insulating layer IL is formed of an insulating material that does not contain glass fiber, the internal insulating layer IL is advantageous for thinning a thickness of the entire coil part 200. When the internal insulating layer IL is formed of an insulating material containing a photosensitive insulating resin, the number of processes may be decreased, which is advantageous for decreasing a manufacturing cost, and a fine hole may be formed.

The insulating film IF may be formed along surfaces of the first coil pattern 211, the internal insulating layer IL, and the second coil pattern 212. The insulating film IF may be formed in order to protect and insulate the respective coil patterns 211 and 212 and contain an insulating material known in the art such as parylene, or the like. Any insulating material may be contained in the insulating film IF without particular limitation. The insulating film IF may be formed by a method such as a vapor deposition method, or the like, but is not limited thereto. The insulating film IF may be formed by stacking an insulation film on both surfaces of the internal insulating layer IL on which the first and second coil patterns 211 and 212 are formed.

Meanwhile, although not illustrated, at least one of the first and second coil patterns 211 and 212 may be formed in plural. As an example, the coil part 200 may have a structure in which a plurality of first coil patterns 211 are formed, and another first coil pattern is stacked on a lower surface of one first coil pattern. In this case, an additional insulating layer may be disposed between the plurality of first coil patterns 211, and the plurality of first coil patterns 211 may be connected to each other by a connection via penetrating through the additional insulating layer, but the first coil pattern 211 is not limited thereto.

The external electrodes 300 and 400 may be disposed on the sixth surface of the body 100 and connected to the coil patterns 211 and 212. The external electrodes 300 and 400 may include a first external electrode 300 connected to the first coil pattern 211 and a second external electrode 400 connected to the second coil pattern 212. More specifically, the first external electrode 300 may include a first connection portion 310 disposed on the first surface of the body 100 and connected to the end portion of the first coil pattern 211 and a first extension portion 320 extended from the first connection portion 310 to the sixth surface of the body 100. The second external electrode 400 may include a second connection portion 410 disposed on the second surface of the body 100 and connected to the end portion of the second coil pattern 212 and a second extension portion 420 extended from the second connection portion 410 to the sixth surface of the body 100. The first extension portion 320 and the second extension portion 420 each disposed on the sixth surface of the body 100 may be spaced apart from each other so that the first and second external electrodes 300 and 400 do not come in contact with each other.

The external electrodes 300 and 400 may electrically connect the coil component 1000 to a printed circuit board, or the like, when the coil component 1000 according to the present exemplary embodiment is mounted on the printed circuit board, or the like. As an example, the coil component 1000 according to the present exemplary embodiment may be mounted on the printed circuit board so that the sixth surface of the body 100 faces an upper surface of the printed circuit board, and the extension portions 320 and 420 of the external electrodes 300 and 400 disposed on the sixth surface of the body 100 and a connection portion of the printed circuit board may be electrically connected to each other by solder, or the like.

The external electrodes 300 and 400 may include conductive resin layers and conductive layers formed on the conductive resin layers, respectively. The conductive resin layer may be formed by printing a paste, or the like, and may contain one or more conductive metals selected from the group consisting of copper (Cu), nickel (Ni), and silver(Ag), and a thermosetting resin. The conductive layer may contain one or more selected from the group consisting of nickel (Ni), copper (Cu), and tin (Sn, and be formed, for example, by plating.

The shielding layer 500 may be disposed on the fifth surface of the body 100 and at least one of the first to fourth surfaces thereof to decrease a leakage magnetic flux leaked from the coil component 1000 according to the present exemplary embodiment to the outside.

The shielding layer 500 may be formed to have a thickness of 10 nm to 100 μm. When the thickness of the shielding layer 500 is less than 10 nm, an EMI shielding effect may be hardly exhibited. When the thickness of the shielding layer 500 is more than 100 μm, a total length, a total width, and a total thickness of the coil component may be increased, which may be disadvantageous for thinning an electronic device.

In the present exemplary embodiment, the shielding layer 500 may include a cap portion 510 disposed on the fifth surface of the body 100 opposing the sixth surface of the body 100, and side wall portions 521 to 524 disposed on the first to fourth surfaces of the body connecting the sixth and fifth surfaces of the body 100 to each other and connected to the cap portion 510. The shielding layer 500 applied to the present exemplary embodiment may be disposed on all the surface of the body 100 except for the sixth surface of the body 100 corresponding to a mounting surface of the coil component 1000 according to the present exemplary embodiment.

First to fourth side wall portions 521 to 524 may be formed integrally with each other. That is, the first to fourth side wall portions 521 to 524 may be formed by the same process, such that there is no boundary therebetween. As an example, the first to fourth side wall portions 521 to 524 may be formed integrally with each other by stacking a single shielding sheet including an insulation film and a shielding film on the first to fifth surfaces of the body 100. Here, the insulation film of the shielding sheet may correspond to an insulating layer 600 to be described below. Meanwhile, in the above-mentioned example, a cross section of a connection region between any one side wall portion and another side wall portion may be formed to be curved due to physical processing of the shielding sheet. As another example, in a case of forming the first to fourth side wall portions 521 to 524 on the first to fourth surfaces of the body 100 on which the insulating layer 600 is formed by vapor deposition such as sputtering, or the like, the first to fourth side wall portions 521 to 524 may be formed integrally with each other. As another example, in a case of forming the first to fourth side wall portions 521 to 524 on the first to fourth surfaces of the body 100 on which the insulating layer 600 is formed by plating, the first to fourth side wall portions 521 to 524 may be formed integrally with each other.

The cap portion 510 and the side wall portions 521 to 524 may be formed integrally with each other. That is, the cap portion 510 and the side wall portions 521 to 524 may be formed by the same process, such that there is no boundary therebetween. As an example, the cap portion 510 and the side wall portions 521 to 524 may be formed integrally with each other by attaching a single shielding sheet including an insulation film and a shielding film on the first to fifth surfaces of the body 100. Here, the insulation film of the shielding sheet may correspond to an insulating layer 600 to be described below. As another example, the cap portion 510 and the side wall portions 521 to 524 may be formed integrally with each other by performing a vapor deposition method such as sputtering on the first to fifth surfaces of the body 100 on which the insulating layer 600 is formed. As another example, the cap portion 510 and the side wall portions 521 to 524 may be formed integrally with each other by performing a plating method on the first to fifth surfaces of the body 100 on which the insulating layer 600 is formed.

The cap portion 510 and the side wall portions 521 to 524 may be connected to each other so as to be curved. As an example, in a case of processing a shielding sheet so as to correspond to a shape of the body and then attaching the processed shielding sheet to the first to fifth surfaces of the body 100, cross-section of connection regions between the cap portion 510 and the side wall portions 521 to 524 may be formed to be curved. As another example, in a case of forming the shielding layer 500 on the first to fifth surfaces of the body 100 on which the insulating layer 600 is formed by vapor deposition such as sputtering, cross-section of connection regions between the cap portion 510 and the side wall portions 521 to 524 may be formed to be curved. As another example, in a case of forming the shielding layer 500 on the first to fifth surfaces of the body 100 on which the insulating layer 600 is formed by plating, cross-section of connection regions between the cap portion 510 and the side wall portions 521 to 524 may be formed to be curved.

The first to fourth side wall portions 521 to 524 may each include one end connected to the cap portion 510 and the other end opposing one end, and the other ends of the first to fourth side wall portions 521 to 524 may each be spaced apart from the sixth surface of the body 100 by a predetermined distance due to a gap portion G to be described below. This will be described later.

The shielding layer 500 may contain at least one of conductive substance and magnetic substances. As an example, the conductive substance may be a metal or alloy including one or more selected from the group consisting of copper (Cu), silver (Ag), gold (Au), aluminum (Al), iron (Fe), silicon (Si), boron (B), chromium (Cr), niobium (Nb), and nickel (Ni), and may be Fe—Si or Fe—Ni. Further, the shielding layer 500 may contain one or more selected from the group consisting of ferrite, Permalloy, and an amorphous ribbon. As an example, the shielding layer 500 may be a copper plating layer, but is not limited thereto. The shielding layer 500 may have a multilayer structure. As an example, the shielding layer may be formed in a double layer structure composed of a conductive substance layer and a magnetic substance layer formed on the conductive substance layer, a double layer structure composed of a first conductive substance layer and a second conductive substance layer formed on the first substance layer, or a plurality of conductive substance layers. Here, the first and second conductive substance layers may contain different conductive substances from each other, but may also contain the same conductive substance as each other.

The shielding layer 500 may include a micro structure of two phases separated from each other. As an example, when each of the cap portion 510 and the side wall portions 521 to 524 are formed of an amorphous ribbon sheet formed to be separated into a plurality of pieces, each of the cap portion 510 and the side wall portions 521 to 524 may include a plurality of micro structures separated from each other. As another example, when the cap portion 510 and the side wall portions 521 to 524 are formed by sputtering, each of the cap portion 510 and the side wall portions 521 to 524 may include a plurality of micro structures separated from each other by grain boundaries.

The insulating layer 600 may be disposed between the body 100 and the shielding layer 500 to electrically separate the shielding layer 500 from the body 100 and the external electrodes 300 and 400. In the present exemplary embodiment, the insulating layer 600 may be disposed on the first to fifth surfaces of the body 100. Since the connection portions 310 and 410 of the external electrodes 300 and 400 are formed on the first and second surfaces of the body 100, the connection portions 310 and 410 of the external electrodes 300 and 400, the insulating layer 600, and the side wall portions 521 and 522 of the shielding layer 500 may be sequentially disposed on the first and second surfaces of the body 100. Since the connection portions 310 and 410 of the external electrodes 300 and 400 are not formed on the third and fourth surfaces of the body 100, the insulating layer 600, and the side wall portions 523 and 524 of the shielding layer 500 may be sequentially disposed on the third and fourth surfaces of the body 100, respectively.

The insulating layer 600 may contain a thermoplastic resin such as a polystyrene based thermoplastic resin, a vinyl acetate based thermoplastic resin, a polyethylene based thermoplastic resin, a polypropylene based thermoplastic resin, a polyamide based thermoplastic resin, a rubber based thermoplastic resin, an acrylic based thermoplastic resin, or the like, a thermosetting resin such as a phenolic thermosetting resin, an epoxy based thermosetting resin, a urethane based thermosetting resin, a melamine based thermosetting resin, an alkyd based thermosetting resin, or the like, a photosensitive resin, parylene, $SiO_x$, or $SiN_x$.

The insulating layer 600 may have an adhesion function. As an example, in a case of forming the insulating layer 600 and the shielding layer 500 using a shielding sheet including an insulation film and a shielding film, the insulation film of the shielding sheet may contain an adhesive ingredient, thereby adhering the shielding film to the surface of the body 100. In this case, an adhesive layer may be separately formed on one surface of the insulating layer 600 between the insulating layer 600 and the body 100. However, as in a case of forming the insulating layer 600 using a B-stage insulation film, a separate adhesive layer may not be formed on one surface of the insulating layer 600.

The insulating layer 600 may be formed by applying a liquid insulating resin on the surface of the body 100, stacking an insulation film such as a dry film (DF) on the surface of the body 100, or forming an insulating resin on the surface of the body 100 by vapor deposition. In the case of the insulation film, an Ajinomoto build-up film (ABF) that does not contain a photosensitive insulating resin, a polyimide film, or the like, may also be used.

The insulating layer 600 may be formed to have a thickness of 10 nm to 100 μm. When the thickness of the insulating layer 600 is less than 10 nm, characteristics such as a Q factor, and the like, of the coil component may be deteriorated, and when the thickness of the insulating layer 600 is more than 100 μm, a total length, a total width, and a total thickness of the coil component may be increased, which may be disadvantageous for thinning an electronic device.

The cover layer 700 may be disposed on the shielding layer 500 to cover the shielding layer 500 but expose an end portion of the shielding layer 500. That is, the cover layer 700 may cover the cap portion 510 and the first to fourth side wall portions 521 to 524 but expose the other ends of the first to fourth side wall portions 521 to 524. All the other ends of the first to fourth side wall portions 521 to 524 may be exposed to the outside of the cover layer 700 or the other end of at least one of the first to fourth side wall portions 521 to 524 may be exposed to the outside of the cover layer 700. The cover layer 700 may prevent the shield layer 500 from being electrically connected to another external electronic component.

The cover layer 700 may contain at least one of thermoplastic resins such as a polystyrene based thermoplastic resin, a vinyl acetate based thermoplastic resin, a polyethylene based thermoplastic resin, a polypropylene based thermoplastic resin, a polyamide based thermoplastic resin, a rubber based thermoplastic resin, an acrylic based thermoplastic resin, and the like, thermosetting resins such as a phenolic thermosetting resin, an epoxy based thermosetting resin, a urethane based thermosetting resin, a melamine based thermosetting resin, an alkyd based thermosetting resin, and the like, a photosensitive insulating resin, parylene, $SiO_x$, and $SiN_x$.

As an example, the cover layer 700 may be formed simultaneously with the insulating layer 600 and the shielding layer 500 by disposing an insulation film of a shielding sheet including the insulation film, a shielding film, and a cover film to face the body and stacking the shielding sheet on the body 100. As another example, the cover layer 700 may be formed by stacking a cover film on the shielding layer 500 formed on the body 100. As another example, the cover layer 700 may be formed on the first to fifth surfaces of the body 100 by forming an insulating material by vapor deposition such as chemical vapor deposition (CVD), or the like.

The cover layer 700 may have an adhesion function. As an example, in the shielding sheet including the insulation film, the shielding film, and the cover film, the cover film may contain an adhesive ingredient so as to adhere to the shielding film.

The cover layer 700 may be formed to have a thickness of 10 nm to 100 μm. When the thickness of the cover layer 700 is less than 10 nm, insulation characteristics may be deteriorated, such that a short-circuit with the external electrode may occur, and when the thickness of the cover layer 700 is more than 100 μm, a total length, a total width, and a total thickness of the coil component may be increased, which may be disadvantageous for thinning an electronic device.

A sum of the thicknesses of the insulating layer 600, the shielding layer 500, and the cover layer 700 may be more than 30 nm to 100 μm or less. When the sum of the thicknesses of the insulating layer 600, the shielding layer 500, and the cover layer 700 is less than 30 nm, problems such as an electrical short-circuit, deterioration of characteristics such as the Q factor, and the like, of the coil component may occur, and when the sum of the thicknesses of the insulating layer 600, the shielding layer 500, and the cover layer 700 more than 100 μm, a total length, a total width, and a total thickness of the coil component may be increased, which may be disadvantageous for thinning an electronic device.

Meanwhile, in forming the cover layer 700, the cover layer 700 may be formed to expose the other ends of the side wall portions 521 to 524 due to tolerances or characteristics of a formation method. In this case, the shielding layer 500 is highly likely to be electrically connected to the external electrodes 300 and 400. Therefore, in the present disclosure, the above-mentioned problem may be solved by having the gap portion G in the side wall portions 521 to 524. The gap portion G is bounded by the other ends of the side wall portions 521 to 524 and the first surface of the body 100.

The gap portion G may be formed in the side wall portions 521 to 524 and the cover layer 700 to expose portions of the wall surface of the body 100. Since the connection portions 310 and 410 of the external electrodes 300 and 400 are formed on the first and second surfaces of the body 100, respectively, the gap portion G may expose at least portions of the connection portions 310 and 410 and the third and fourth surfaces of the body 100, respectively.

The gap portion G may allow the other ends of the respective side wall portions 521 to 524 to be spaced apart from the sixth surface of the body 100, the mounting surface of the coil component 1000, more precisely, lower surfaces of the extension portions 320 and 420 of the external electrodes 300 and 400-by a predetermined distance. As an example, when the coil component 1000 is mounted on a printed circuit board, or the like, solder, or the like, may climb up the connection portions 310 and 410, but since the gap portion G is bounded by the other ends of the side wall portions 521 to 524 and the first surface of the body 100, the gap portion G may prevent the side wall portions 521 to 524 and the external electrodes 300 and 400 from being electrically connected to each other by the solder, or the like.

The gap portion G may be formed to have a length of more than 0 to 150 μm or less. Referring to FIG. 3, it may be appreciated that as compared to a case in which the shielding layer is not formed (a portion represented by air in an X axis of FIG. 3), in a case in which the shielding layer is formed (a right side portion of the portion represented by air in the X axis of FIG. 3), an amount of the leakage magnetic flux is decreased and thus, a shielding effect is increased. Referring to FIGS. 1 and 2B, since the number of turns of the coil part 200 adjacent to the third surface of the body 100 is larger than the number of turns of the coil part 200 adjacent to the fourth surface of the body 100, as illustrated in FIG. 3, an amount of the magnetic flux leaked through the third surface of the body 100 may be larger than that of the magnetic flux leaked through the fourth surface of the body 100.

It may be appreciated that when the length of the gap portion G is 0, that is, the other ends of the side wall portions 521 to 524 and the lower surfaces of the extension portions 320 and 420 of the external electrodes 300 and 400 are positioned substantially on the same plane, the shielding effect is largest. However, in this case, as described above, at the time of mounting the coil component, the shielding layer and the external electrodes are highly likely to be electrically connected to each other by the solder.

As the length of the gap portion G, that is, a distance between the other ends of the side wall portions 521 to 524 and the lower surfaces of the extension portions 320 and 420 of the external electrodes 300 and 400, is increased to 50 μm, 100 μm, and 150 μm, respectively, the amounts of the magnetic flux leaked through the third and fourth surfaces of the body 100, respectively, may be gradually increased. However, even in a case in which the length of the gap portion G is 150 μm, since the amounts of the leakage magnetic flux in the third and fourth surfaces of the body 100 are decreased by 61.1% and 92.8%, respectively, as compared to a case in which the shielding layer is not formed, the shielding effect may be exhibited, and electrical connection between the shielding layer 500 and the external electrodes 300 and 400 may be prevented.

Meanwhile, although not illustrated in FIGS. 1 through 2B, a separate additional insulating layer distinguished form the insulating layer 600 may be formed on regions of the first to sixth surfaces of the body 100 on which the external electrodes 300 and 400 are not formed. That is, the separate additional insulating layer distinguished form the insulating layer 600 may be formed on the third to fifth surfaces of the body 100 and region of the sixth surface of the body 100 on which the extension portions 320 and 420 are not formed. In this case, the insulating layer 600 in the present exemplary embodiment may be formed on the surface of the body 100 so as to come in contact with the additional insulating layer. The additional insulating layer may serve as a plating resist in forming the external electrodes 300 and 400 by plating, but is not limited thereto.

Since the insulating layer 600 and the cover layer 700 according to the present disclosure are disposed in the coil component itself, the insulating layer 600 and the cover layer 700 may be distinguished from a molding member molding the coil component and a printed circuit board in the mounting of the coil component on the printed circuit board. As an example, formation regions of the insulating layer 600 and the cover layer 700 according to the present disclosure may be defined without the printed circuit board unlike the molding member. Therefore, the insulating layer 600 according to the present disclosure does not come in contact with the printed circuit board and is not supported or fixed by the printed circuit board unlike the molding member. Further, unlike the molding member enclosing a connection member such as solder balls, or the like, connecting the coil component and the printed circuit board, the insulating layer 600 and the cover layer 700 according to the present disclosure are not formed to enclose the connection member. In addition, since the insulating layer 600 according to the present disclosure is not a molding member formed by heating, flowing, and curing an epoxy molding compound, or the like, onto the printed circuit board, there is no need to consider voids occurring at the time of forming the molding member, warpage occurring due to a difference in coefficient of thermal expansion between the molding member and the printed circuit board, and the like.

Further, since the shielding layer 500 according to the present disclosure is disposed in the coil component itself, the shield layer 500 may be distinguished from a shield can coupled to the printed circuit board in order to shield EMI, or the like, after the coil component is mounted on the printed circuit board. As an example, in the shielding layer 500 according to the present disclosure, there is no need to consider connection with a ground layer of the printed circuit board, unlike the shield can.

The coil component according to the present exemplary embodiment may prevent an electrical short-circuit between the shield layer 500 and the external electrodes 300 and 400 while blocking the leakage magnetic flux generated in the coil component by forming the shielding layer 500 in the coil component itself and forming the gap portion G in the side wall portions 521 to 524. In accordance with thinness and high performance of an electronic device, a total number of electronic components included in the electronic device have increased and a distance between adjacent electronic components has decreased. According to the present disclosure, each coil component itself may be shielded, and thus the leakage magnetic flux generated in each coil component may be efficiently blocked, which is more advantageous for thinness and high performance of the electronic device. In addition, since an amount of an effective magnetic substance in a shielding region is increased as compared to a case of using a shield can, characteristics of the coil component may be improved.

Second Exemplary Embodiment

Figure 4A:
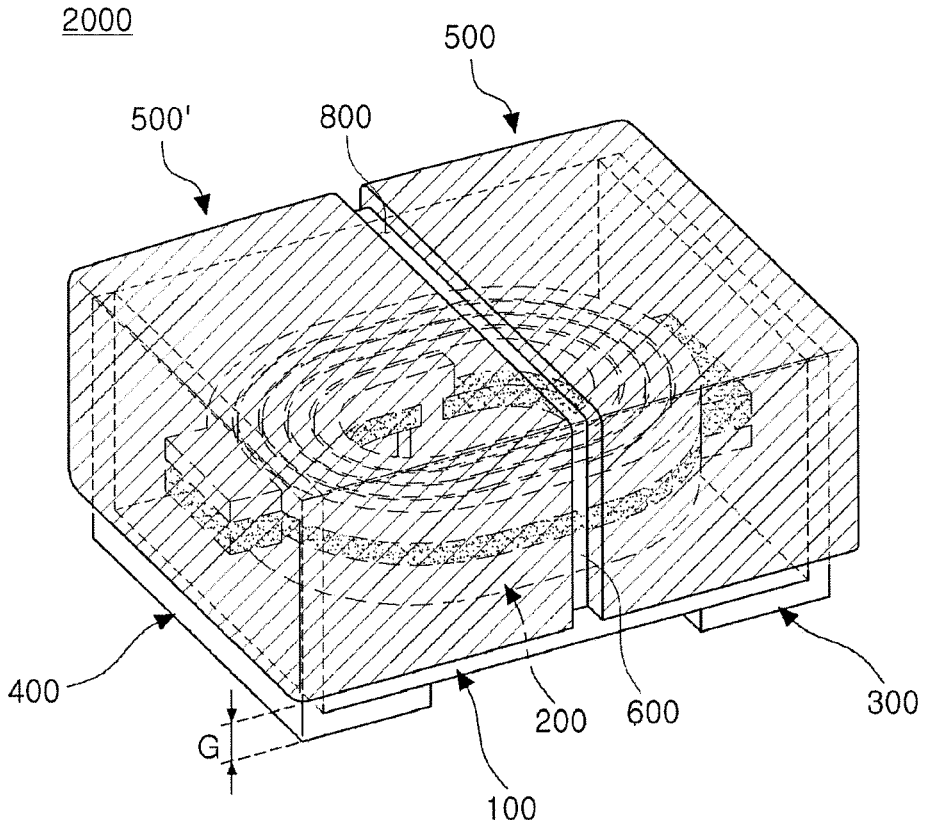
FIG. 4A is a perspective view schematically showing a coil component according to a second exemplary embodiment in the present disclosure.
Figure 4B:
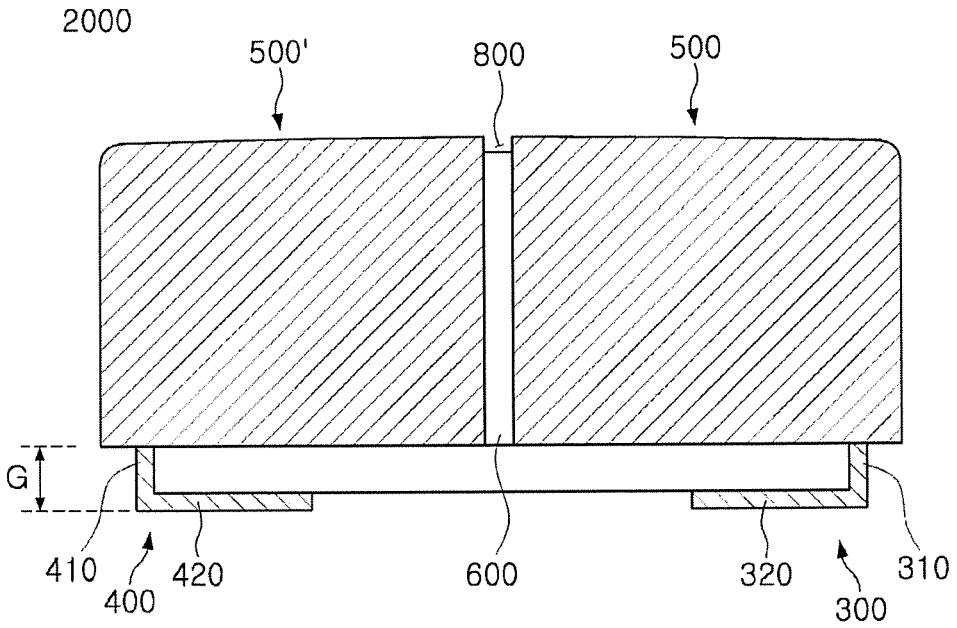
FIG. 4B is a front view schematically showing the coil component according to the second exemplary embodiment in the present disclosure.

FIG. 4A is a perspective view schematically showing a coil component according to a second exemplary embodiment in the present disclosure. FIG. 4B is a front view schematically showing the coil component according to the second exemplary embodiment in the present disclosure. Meanwhile, for convenience and understanding of explanation, a cover layer 700 is not illustrated in FIGS. 4A and 4B.

Referring to FIGS. 1 through 4B, a coil component 2000 according to the present exemplary embodiment is different in shielding layers 500 and 500' from the coil component 1000 according to the first exemplary embodiment. Therefore, in describing the present exemplary embodiment, only the shielding layers 500 and 500' different from that in the first exemplary embodiment in the present disclosure will be described. To the other configurations in the present exemplary embodiment, a description of those in the first exemplary embodiment may be applied as it is.

Referring to FIGS. 4A and 4B, the coil component 2000 according to the present exemplary embodiment may include a slip portion 800 continuously formed in a cap portion 510 and side wall portions 521 to 524 to separate a plurality of shielding layers 500 and 500' from each other.

More specifically, the slit portion 800 may be formed in the cap portion 510 and extended to the other ends of the third and fourth side wall portions 523 and 524. Therefore, the shielding layers 500 and 500' may be electrically separated from each other. In this case, the shielding layers 500 and 500' may be divided into a right portion 500 continuously disposed on first, third, fourth, and fifth surfaces of a body 100, and a left portion 500' continuously disposed on second, third, fourth, and fifth surfaces of the body 100. The right and left portions may be formed to be spaced apart from each other, such that even though a first side portion 521 of the right portion is electrically connected to a first external electrode 300, an electrical short-circuit between first and second external electrodes 300 and 400 may be prevented. Similarly, even though a second side portion 522 of the left portion is electrically connected to a second external electrode 400, the electrical short-circuit between first and second external electrodes 300 and 400 may be prevented.

Meanwhile, although a case in which a single slit portion 800 is formed is illustrated in FIGS. 4A and 4B, this case is provided by way of example, and the slit portion 800 may be formed in plural.

Further, since the slit portion 800 illustrated in FIGS. 4A and 4B is illustrated on the assumption that the first and second external electrodes 300 and 400 are formed on the first and second surfaces of the body 100, when positions of the first and second external electrodes 300 and 400 on the body 100 are changed, a shape of the slit 800 may also be different from that in FIG. 4. That is, any slit portion may also be included in the slit portion 800 according to the present exemplary embodiment as long as it separates the shielding layer 500 into two or more portions in order to electrically separate the first and second external electrodes 300 and 400 from each other.

In the coil component 2000 according to the present exemplary embodiment, even though the shielding layers 500 and 500' are electrically connected to the external electrodes 300 and 400, respectively, the electrical short-circuit between the external electrodes 300 and 400 may be prevented by the slit portion 800.

Third Exemplary Embodiment

Figure 5:
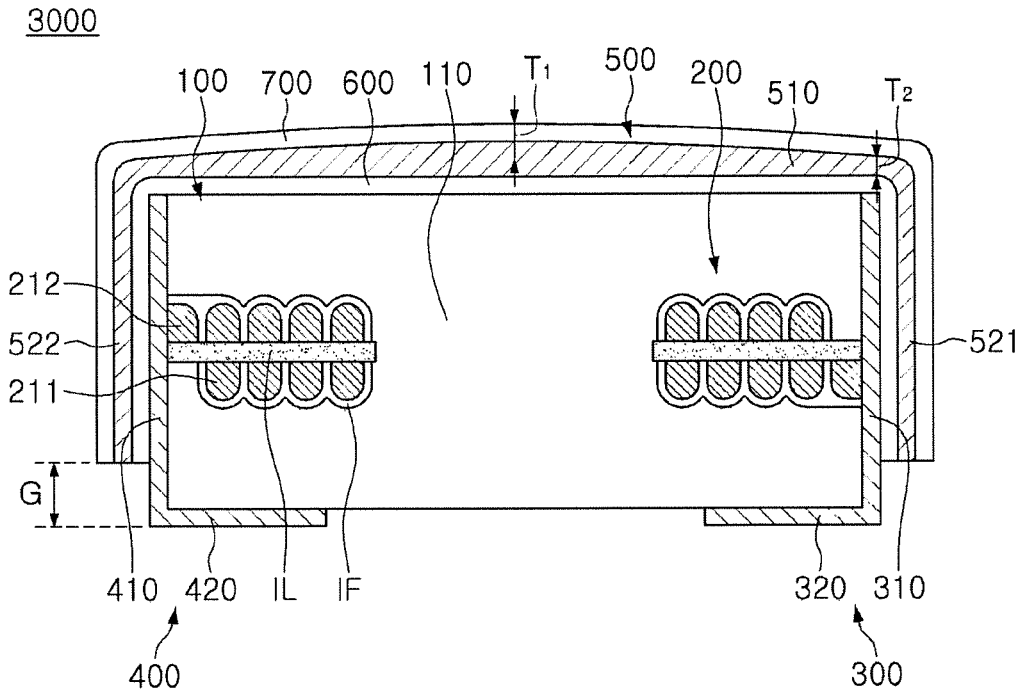
FIG. 5 is a cross-sectional view of a coil component according to a third exemplary embodiment in the present disclosure, corresponding to the cross-sectional view taken along line I-I of FIG. 1.

FIG. 5 is a cross-sectional view of a coil component according to a third exemplary embodiment in the present disclosure, corresponding to the cross-sectional view taken along line I-I of FIG. 1.

Referring to FIGS. 1 through 5, a coil component 3000 according to the present exemplary embodiment is different in a cap portion 510 from the coil components 1000 and 2000 according to the first and second exemplary embodiments. Therefore, in describing the present exemplary embodiment, only the cap portion 510 different from that in the first and second exemplary embodiments in the present disclosure will be described. To the other configurations in the present exemplary embodiment, a description of those in the first and second exemplary embodiments may be applied as it is.

Referring to FIG. 5, the cap portion 510 may be formed so that a thickness $T_1$ of a central portion thereof is larger than a thickness $T_2$ in an outer portion thereof. This will be described in detail.

Respective coil patterns 211 and 212 constituting a coil part 200 according to the exemplary embodiment may form a plurality of turns on both surfaces of an internal insulating layer IL, respectively, from the center of the internal insulating layer IL to an outer portion of the internal insulating layer, and be stacked in a thickness (T) direction of a body 100 to thereby be electrically connected to each other by a via 220. As a result, in the coil component 2000 according to the present exemplary embodiment, a magnetic flux density is highest in a central portion of a plane of the body 100 in a length (L)-width (W) direction perpendicular to the thickness (T) direction of the body 100. Therefore, according to the present exemplary embodiment, in forming the cap portion 510 disposed on a fifth surface of the body 100 which is substantially parallel with the plane of the body 100 in the length (L)-width (W) direction, in consideration of the magnetic flux density in the plane of the body 100 in a length (L)-width (W) direction, the cap portion 510 may be formed so that the thickness $T_1$ of the central portion of the cap portion 510 is larger than the thickness $T_2$ of the outer portion thereof.

Therefore, in the coil component 3000 according to the present exemplary embodiment, a leakage magnetic flux may be more efficiently decreased corresponding to magnetic flux distribution.

Fourth Exemplary Embodiment

Figure 6:
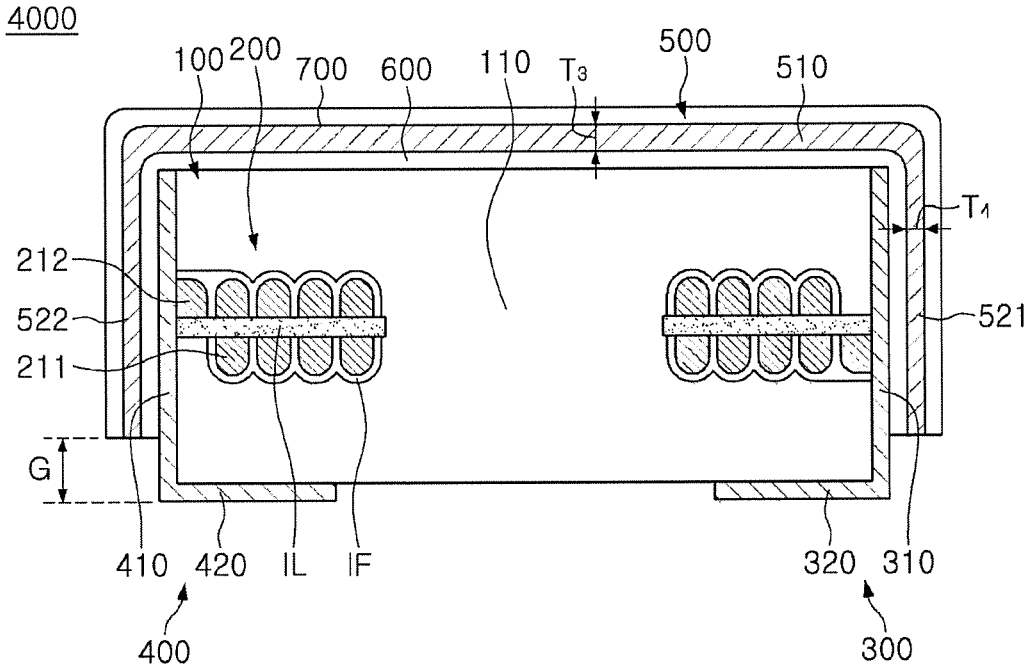
FIG. 6 is a cross-sectional view of a coil component according to a fourth exemplary embodiment in the present disclosure, corresponding to the cross-sectional view taken along line I-I of FIG. 1.

FIG. 6 is a cross-sectional view of a coil component according to a fourth exemplary embodiment in the present disclosure, corresponding to the cross-sectional view taken along line I-I of FIG. 1.

Referring to FIGS. 1 through 6, a coil component 4000 according to the present exemplary embodiment is different in a cap portion 510 and side wall portions 521 to 524 from the coil components 1000, 2000, and 3000 according to the first to third exemplary embodiments. Therefore, in describing the present exemplary embodiment, only the cap portion 510 and the side wall portions 521 to 524 different from those in the first to third exemplary embodiments in the present disclosure will be described. To the other configurations in the present exemplary embodiment, a description of those in the first to third exemplary embodiments may be applied as it is.

Referring to FIG. 6, a thickness T3 of the cap portion 510 may be larger than a thickness T4 of the side wall portions 521 to 524.

As described above, a coil part 200 may generate a magnetic field in a thickness (T) direction of a body 100. As a result, a magnetic flux leaked in the thickness (T) direction of the body 100 may be larger than a magnetic flux leaked in other directions. Therefore, a leakage magnetic flux may be efficiently decreased by forming the cap portion 510 disposed on a fifth surface of the body 100 perpendicular to the thickness (T) direction of the body 100 to have a larger thickness than that of the side wall portions 521 to 524 formed on wall surfaces of the body 100.

As an example, the cap portion 510 may be formed to have a larger thickness than that of the side wall portions 521 to 524 by forming a temporary shielding layer on first to fifth surfaces of the body 100 using a shielding sheet including an insulation film and a shielding film and additionally forming a shielding material only on the fifth surface of the body 100. As another example, the cap portion 510 may be formed to have a larger thickness than that of the side wall portions 521 to 524 by performing the sputtering for forming a shielding layer 500 after disposing the body 100 so that the fifth surface of the body 100 to face a target. However, the scope of the present disclosure is not limited by the above-mentioned examples.

Fifth Exemplary Embodiment

Figure 7:
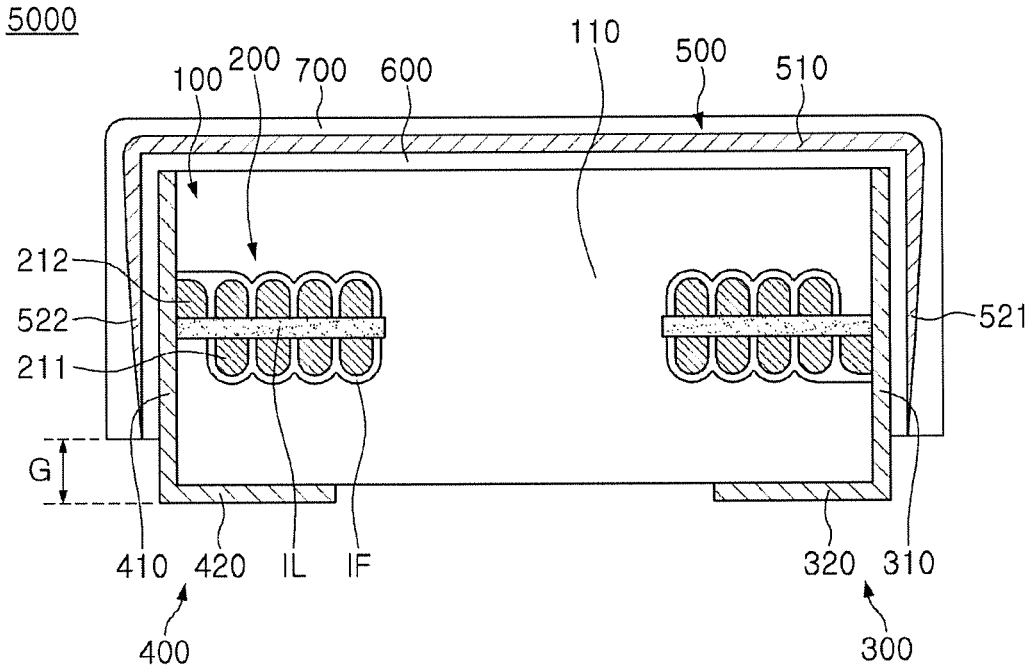
FIG. 7 is a cross-sectional view of a coil component according to a fifth exemplary embodiment in the present disclosure, corresponding to the cross-sectional view taken along line I-I of FIG. 1.

FIG. 7 is a cross-sectional view of a coil component according to a fifth exemplary embodiment in the present disclosure, corresponding to the cross-sectional view taken along line I-I of FIG. 1.

Referring to FIGS. 1 through 7, a coil component 5000 according to the present exemplary embodiment is different in side wall portions 521 to 524 from the coil components 1000, 2000, 3000, and 4000 according to the first to fourth exemplary embodiments. Therefore, in describing the present exemplary embodiment, only the side wall portions 521 to 524 different from those in the first to fourth exemplary embodiments in the present disclosure will be described. To the other configurations in the present exemplary embodiment, a description of those in the first to fourth exemplary embodiments may be applied as it is.

Referring to FIG. 7, a thickness of one ends of the side wall portions 521 to 524 may be larger than that of the other ends of the side wall portions 521 to 524.

As an example, in a case of forming a cap portion 510 and the side wall portions 521 to 524 by plating, a current density may be concentrated on edge portions of a body 100 in which a fifth surface of the body 100 and first to fourth surfaces of the body 100 are connected to each other, that is, regions in which one ends of the side wall portions 521 to 524 will be formed due to an edged shape of the corresponding regions. Therefore, one ends of the side wall portions 521 to 524 may be formed to have a relatively larger thickness than that of the other ends of the side wall portions 521 to 524. As another example, one ends of the side wall portions 521 to 524 may be formed to have a relatively larger thickness than that of the other ends of the side wall portions 521 to 524 by performing the sputtering for forming a shielding layer 500 after disposing the body 100 so that the fifth surface of the body 100 to face a target. However, the scope of the present modified exemplary embodiment is not limited by the above-mentioned examples.

In this way, in the coil component 4000 according to the present exemplary embodiment, a leakage magnetic flux may be more efficiently decreased in consideration of a direction of a magnetic field formed by a coil part 200.

Sixth Exemplary Embodiment

Figure 8:
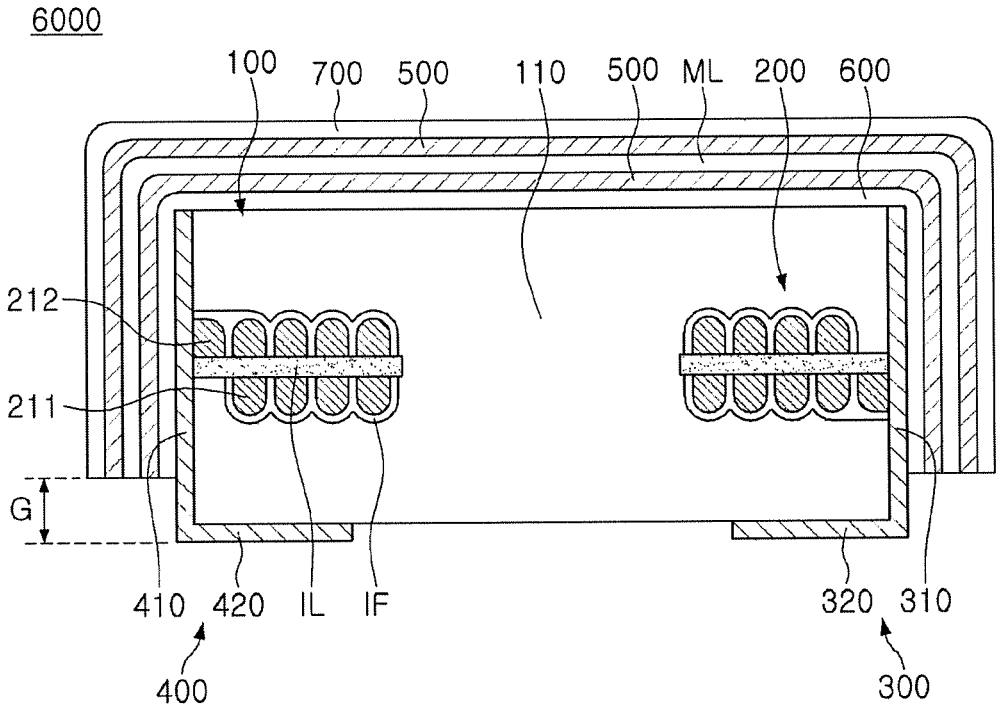
FIG. 8 is a cross-sectional view of a coil component according to a sixth exemplary embodiment in the present disclosure, corresponding to the cross-sectional view taken along line I-I of FIG. 1.

FIG. 8 is a cross-sectional view of a coil component according to a sixth exemplary embodiment in the present disclosure, corresponding to the cross-sectional view taken along line I-I of FIG. 1.

Referring to FIGS. 1 through 8, a coil component 6000 according to the present exemplary embodiment is different in a structure of a shielding layer 500 from the coil components 1000, 2000, 3000, 4000, and 5000 according to the first to fifth exemplary embodiments. Therefore, in describing the present exemplary embodiment, only the shielding layer 500 different from that in the first to fifth exemplary embodiments in the present disclosure will be described. To the other configurations in the present exemplary embodiment, a description of those in the first to fifth exemplary embodiments may be applied as it is.

Referring to FIG. 8, the shielding layer 500 applied to the present exemplary embodiment may be formed in a double layer structure in which a middle insulating layer ML is interposed therebetween.

In the present exemplary embodiment, since the shielding layer 500 is formed in the double layer structure, a leakage magnetic flux penetrating through a first shielding layer 500 disposed to be relatively adjacent to a body 100 may be shielded by a second shielding layer 500 disposed to be relatively spaced apart from the body 100. Therefore, in the coil component 6000 according to the present exemplary embodiment, the leakage magnetic flux may be more efficiently blocked. The middle insulating layer ML may serve as a wave guide of noise reflected in the second shielding layer 500.

A description of the insulating layer 600 in the first to fifth exemplary embodiments in the present disclosure may be applied as it is to a description of a material, a formation method, and the like, of the middle insulating layer ML.

Meanwhile, in the above-mentioned exemplary embodiments in the present disclosure, a description is provided on the assumption that the external electrodes 300 and 400 applied to the present disclosure are "L"-shaped electrodes composed of the connection portions 310 and 410 and the extension portions 320 and 420, but this is only for convenience of explanation. Therefore, shapes of the external electrodes 300 and 400 may be variously changed. As an example, the external electrodes 300 and 400 are not formed on the first and second surfaces of the body 100 but may be formed only the sixth surface of the body 100 to thereby be connected to the coil part 200 through a via electrode, or the like. As another example, the external electrodes 300 and 400 may be "C"-shaped electrodes including connection portions formed on the first and second surfaces of the body 100, respectively, extension portions extended from the connection portions and disposed on the sixth surface of the body, and band portions extended from the connection portions and disposed on the fifth surface of the body 100, respectively. As another example, the external electrodes 300 and 400 may be five-face electrodes including connection portions formed on the first and second surfaces of the body 100, extension portions extended from the connection portions and disposed on the sixth surface of the body 100, and band portions extended from the connection portions and disposed on the third to fifth surfaces of the body 100, respectively.

Further, in the exemplary embodiments in the present disclosure described above, a description is provided on the assumption that a structure of the coil part is a structure of a so-called thin film coil in which the coil pattern is formed by plating, sputtering, or the like, a multilayer coil or a vertically disposed coil are also included in the scope of the present disclosure. The multilayer coil means a coil formed by stacking and curing a plurality of magnetic sheets after applying a conductive paste on respective magnetic sheets. The vertically disposed coil means a coil in which a coil pattern forms a turn to be perpendicular to a lower surface of a coil component corresponding to a mounting surface.

As set forth above, according to exemplary embodiments in the present disclosure, the leakage magnetic flux of the coil component may be decreased.

Further, the leakage magnetic flux of the coil component may be decreased, and at the same time, the characteristics of the component may be substantially maintained.

While exemplary embodiments have been shown and described above, it will be apparent to those skilled in the art that modifications and variations could be made without departing from the scope of the present invention as defined by the appended claims.

What is claimed is:

1. A coil component comprising:

a body having a first surface and a second surface opposing each other in a thickness direction of the body and a wall surface connecting the first surface and the second surface to each other;

a coil part including coil patterns embedded in the body and including at least one turn centered on an axis in the thickness direction;

external electrodes disposed on the first surface of the body and electrically connected to the coil part;

a shielding layer including a cap portion disposed on the second surface of the body and side wall portions disposed on the wall surface of the body, each of the side wall portions having a first end connected to the cap portion and a second end opposing the first end;

an insulating layer disposed between the body and the shielding layer; and a gap portion bounded by the second end of the shielding layer and the first surface of the body to expose portions of the wall surface of the body.

2. The coil component of claim 1, wherein the gap portion is formed to have a length of more than 0 to 150 μm or less in the thickness direction of the body.

3. The coil component of claim 1, further comprising a slit portion continuously formed in the cap portion and the side wall portions to separate the shielding layer into a plurality of portions.

4. The coil component of claim 1, further comprising a cover layer disposed on the shielding layer and exposing the second end of each of the side wall portions.

5. The coil component of claim 1, wherein the cap portion has a thickness in a central portion of the second surface of the body larger than a thickness in an outer portion of the second surface of the body.

6. The coil component of claim 1, wherein the cap portion and the side wall portions are formed integrally with each other.

7. The coil component of claim 6, wherein the cap portion and the side wall portions are connected to each other so as to be curved.

8. The coil component of claim 1, wherein the cap portion has a thickness larger than thicknesses of the side wall portions.

9. The coil component of claim 1, wherein the wall surface of the body is formed in plural, and the side wall portions are disposed on a plurality of wall surfaces of the body, respectively.

10. The coil component of claim 1, wherein each of the external electrodes includes:

a connection portion disposed on the wall surface of the body and connected to the coil part; and an extension portion extending from the connection portion and disposed on the first surface of the body.

11. The coil component of claim 1, wherein the shielding layer is a double layer structure in which a middle insulating layer is interposed therebetween.

12. The coil component of claim 1, wherein a thickness of the first end of each of the side wall portions is larger than a thickness of the second end of each of the side wall portions.

13. A coil component comprising:

a body having a first surface and a second surface opposing each other in a thickness direction of the body and a plurality of wall surfaces connecting the first surface and the second surface to each other;

a coil part including first and second coil patterns embedded in the body and stacked in the thickness direction;

first and second external electrodes disposed on the first surface of the body to be spaced apart from each other, and connected to the first and second coil patterns, respectively;

a shielding layer including a cap portion disposed on the second surface of the body and side wall portions disposed on the plurality of wall surfaces of the body, respectively, and each having a first end connected the cap portion and a second end opposing the first end;

an external insulating layer disposed between the body and the shielding layer and between the first and second external electrodes and the shielding layer; and a gap portion bounded by the second end of the shielding layer and the first surface of the body and allowing the second end of each of the side wall portions to be spaced apart from the first surface of the body in the thickness direction.

14. The coil component of claim 13, further comprising a cover layer disposed on the shielding layer and exposing the second end of each of the side wall portions.

* * * * *